US009113735B1

(12) United States Patent
Jansma

(10) Patent No.: US 9,113,735 B1
(45) Date of Patent: Aug. 25, 2015

(54) POST DRINK HOLDER DEVICE

(71) Applicant: Todd Jansma, Rock Rapids, IA (US)

(72) Inventor: Todd Jansma, Rock Rapids, IA (US)

( * ) Notice: Subject to any disclaimer, the term of this patent is extended or adjusted under 35 U.S.C. 154(b) by 0 days.

(21) Appl. No.: 14/581,440

(22) Filed: Dec. 23, 2014

(51) Int. Cl.
*A47B 85/00* (2006.01)
*A47G 23/02* (2006.01)
*F16M 13/02* (2006.01)

(52) U.S. Cl.
CPC ..... *A47G 23/0208* (2013.01); *F16M 13/02* (2013.01)

(58) Field of Classification Search
CPC ..... A47B 37/04; A47B 2220/0008; A47B 11/00; A47B 2200/02; A45B 2025/186
USPC ..... 108/50.12, 25, 26, 94, 50.11, 42; 135/96; 248/530
See application file for complete search history.

(56) References Cited

U.S. PATENT DOCUMENTS 2,805,109 A * 9/1957 Kopmar ..... 108/25
2,897,974 A 8/1959 Cook
3,090,478 A 5/1963 Stanley
3,624,732 A * 11/1971 Bowden ..... 108/50.12
4,524,701 A 6/1985 Chappell
D285,638 S * 9/1986 Trivison ..... D7/557
4,623,367 A * 11/1986 Paulson ..... 108/50.12
4,920,897 A * 5/1990 Reed et al. ..... 108/150
5,335,803 A * 8/1994 O'Brien et al. ..... 108/50.12
5,860,534 A * 1/1999 Minneman et al. ..... 108/25
6,105,509 A * 8/2000 Altfeder ..... 108/42
6,109,580 A 8/2000 Stern
D445,619 S * 7/2001 Achey ..... D6/511
6,474,244 B1 * 11/2002 Karpinski ..... 108/42
6,520,366 B1 2/2003 Bradley et al.
6,889,618 B1 * 5/2005 Gromack ..... 108/151
7,000,799 B1 2/2006 Hamre
D546,127 S * 7/2007 Vovan ..... D7/552.2
7,290,746 B1 11/2007 Macias et al.
7,779,589 B2 * 8/2010 Salman ..... 248/156
8,136,458 B1 * 3/2012 Cass et al. ..... 108/50.12
8,381,662 B2 2/2013 Goldszer
8,544,390 B1 * 10/2013 Bahnsen ..... 108/94
8,640,894 B1 * 2/2014 Cronin ..... 108/50.12
2002/0036008 A1 * 3/2002 Hickam et al. ..... 108/50.12
2003/0230684 A1 12/2003 Clary
2004/0129184 A1 * 7/2004 Kraker ..... 108/50.12
2014/0102337 A1 * 4/2014 Ralph et al. ..... 108/25

* cited by examiner

*Primary Examiner* — Jose V Chen

(57) ABSTRACT

A post drink holder device securely holds multiple beverage containers on an existing post such as a on a boat dock. The device includes a base wall coupled to and extending downwardly from a lower surface of a panel defining a post receiver for receiving a post therein such that the panel is supported on the post. An upper wall is coupled to and extends upwardly from an upper surface of the panel defining a primary cup for receiving a beverage container. Each of a plurality of outer cups extends into the upper surface and through the panel for holding additional beverage containers.

15 Claims, 5 Drawing Sheets

POST DRINK HOLDER DEVICE

BACKGROUND OF THE DISCLOSURE

Field of the Disclosure

The disclosure relates to drink holder devices and more particularly pertains to a new drink holder device for securely holding multiple beverage containers on an existing post such as a on a boat dock.

SUMMARY OF THE DISCLOSURE

An embodiment of the disclosure meets the needs presented above by generally comprising a base wall coupled to and extending downwardly from a lower surface of a panel defining a post receiver for receiving a post therein such that the panel is supported on the post. An upper wall is coupled to and extends upwardly from an upper surface of the panel defining a primary cup for receiving a beverage container. Each of a plurality of outer cups extends into the upper surface and through the panel for holding additional beverage containers.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
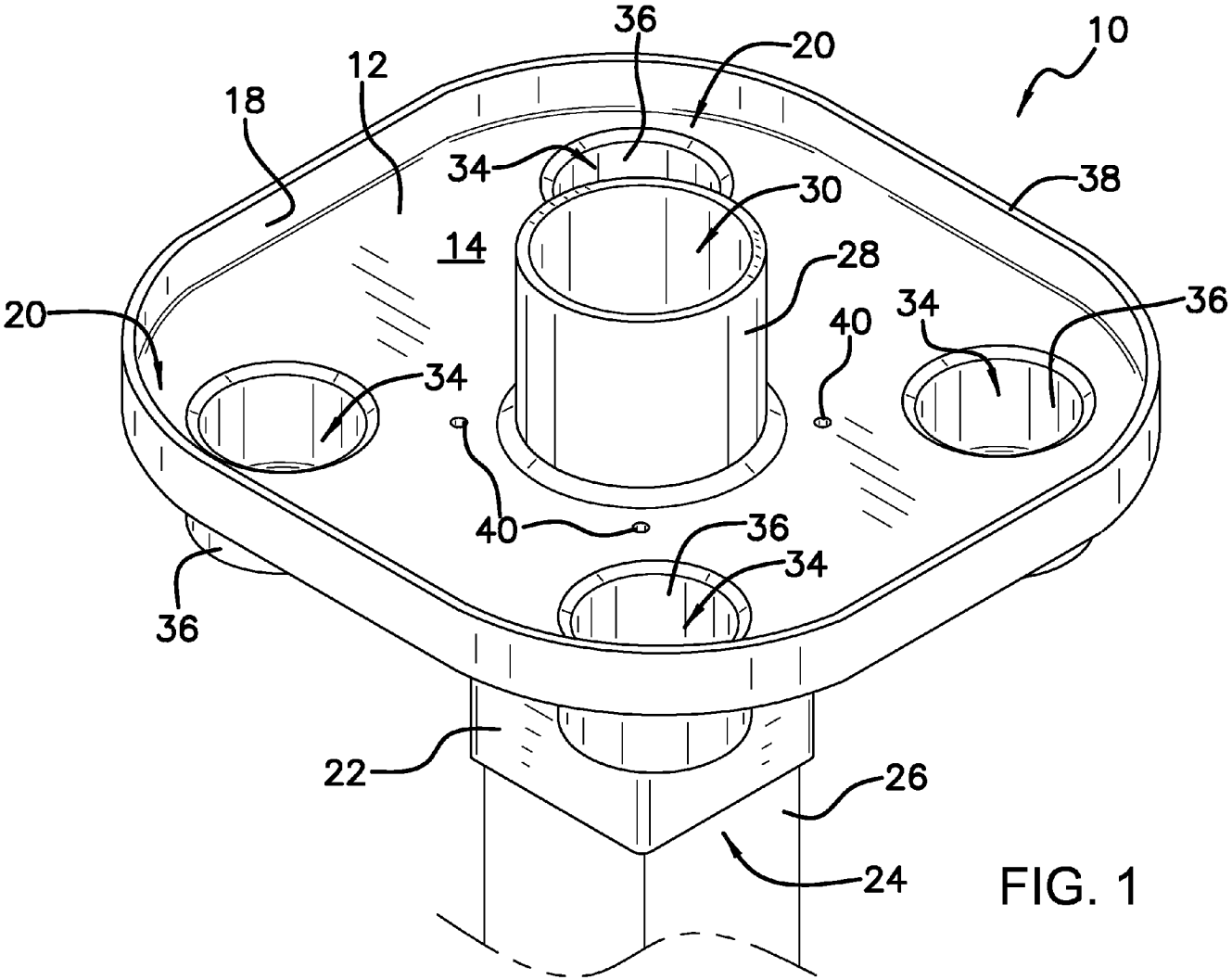
FIG. 1 is a top front side perspective view of a post drink holder device according to an embodiment of the disclosure.
Figure 2:
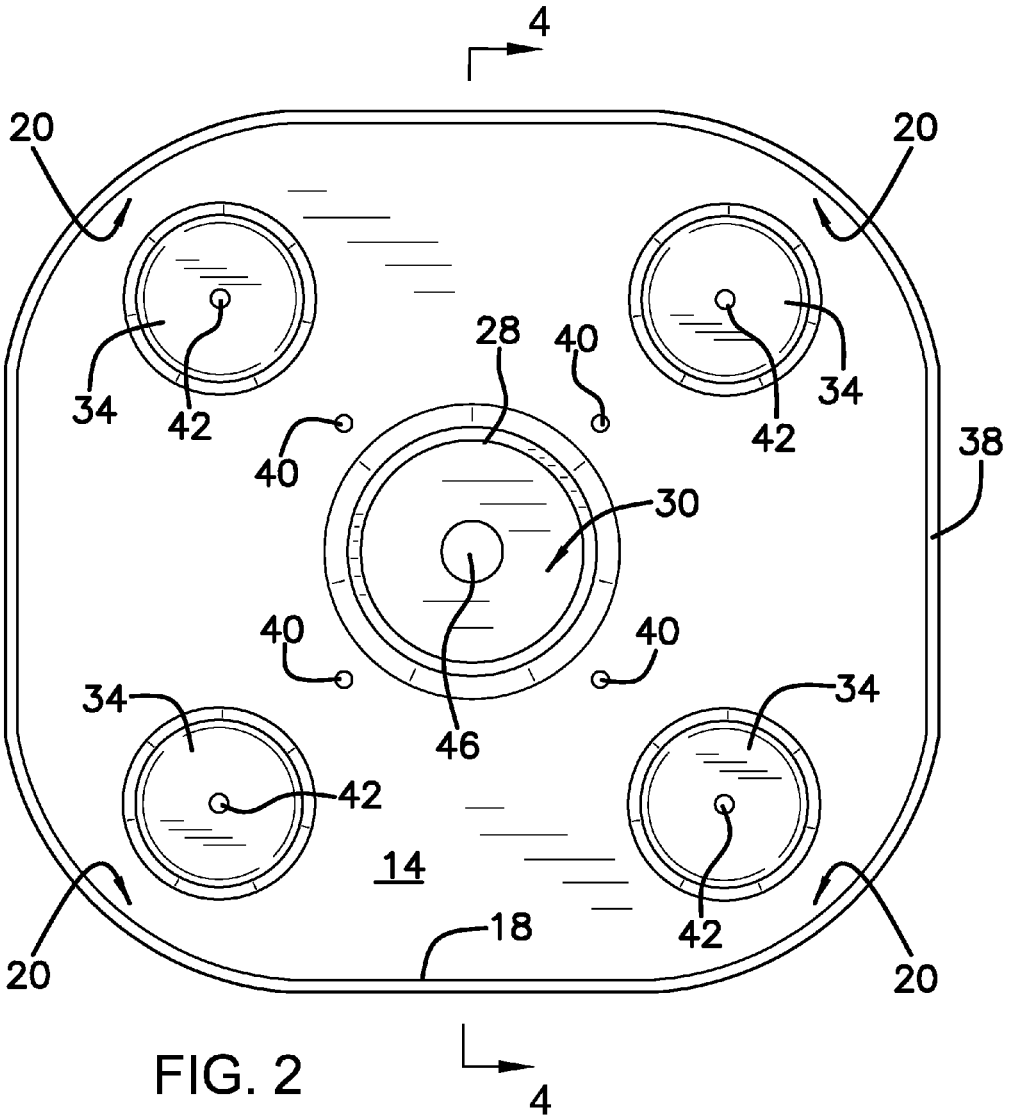
FIG. 2 is a top view of an embodiment of the disclosure.
Figure 3:
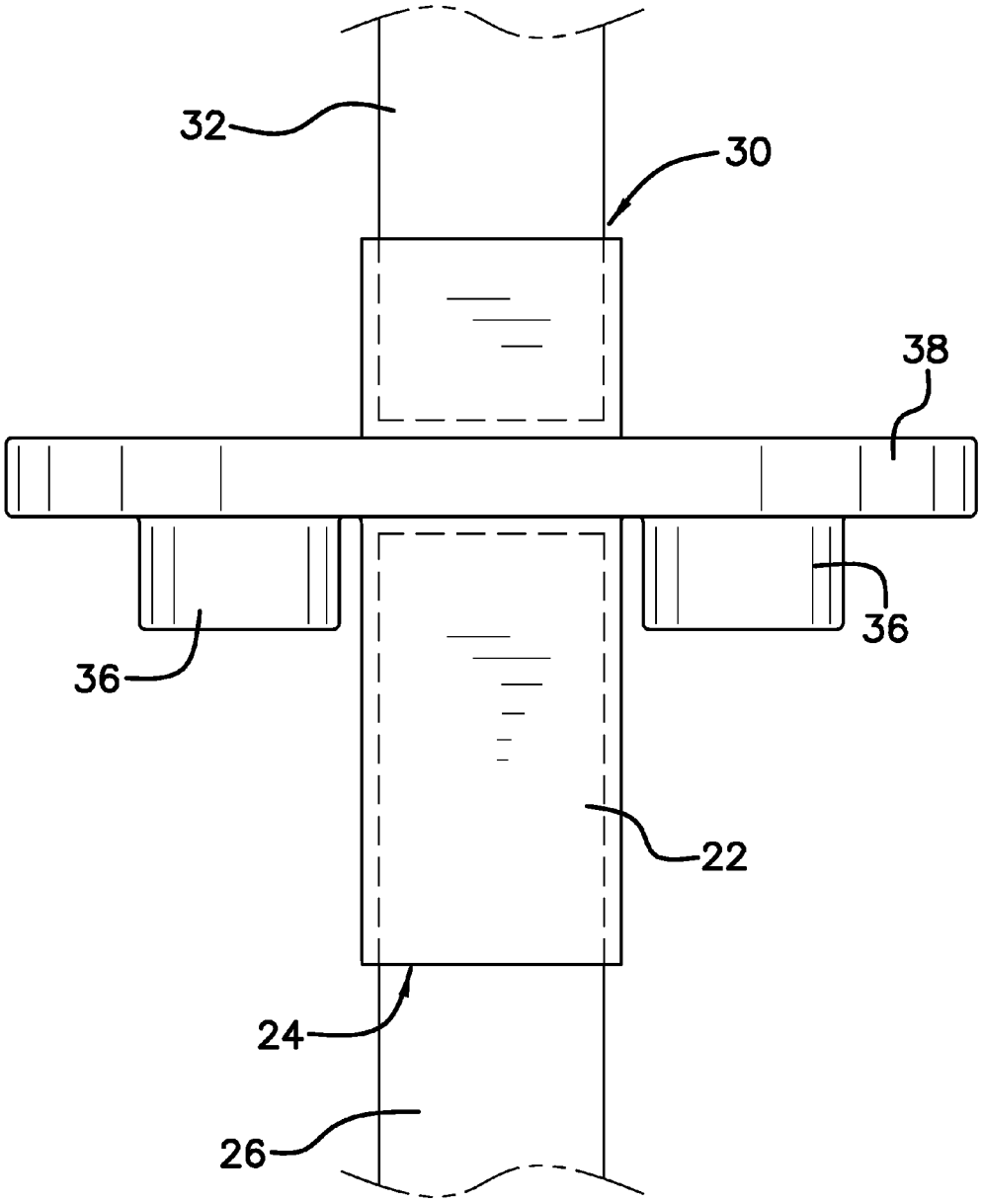
FIG. 3 is a side view of an embodiment of the disclosure.
Figure 4:
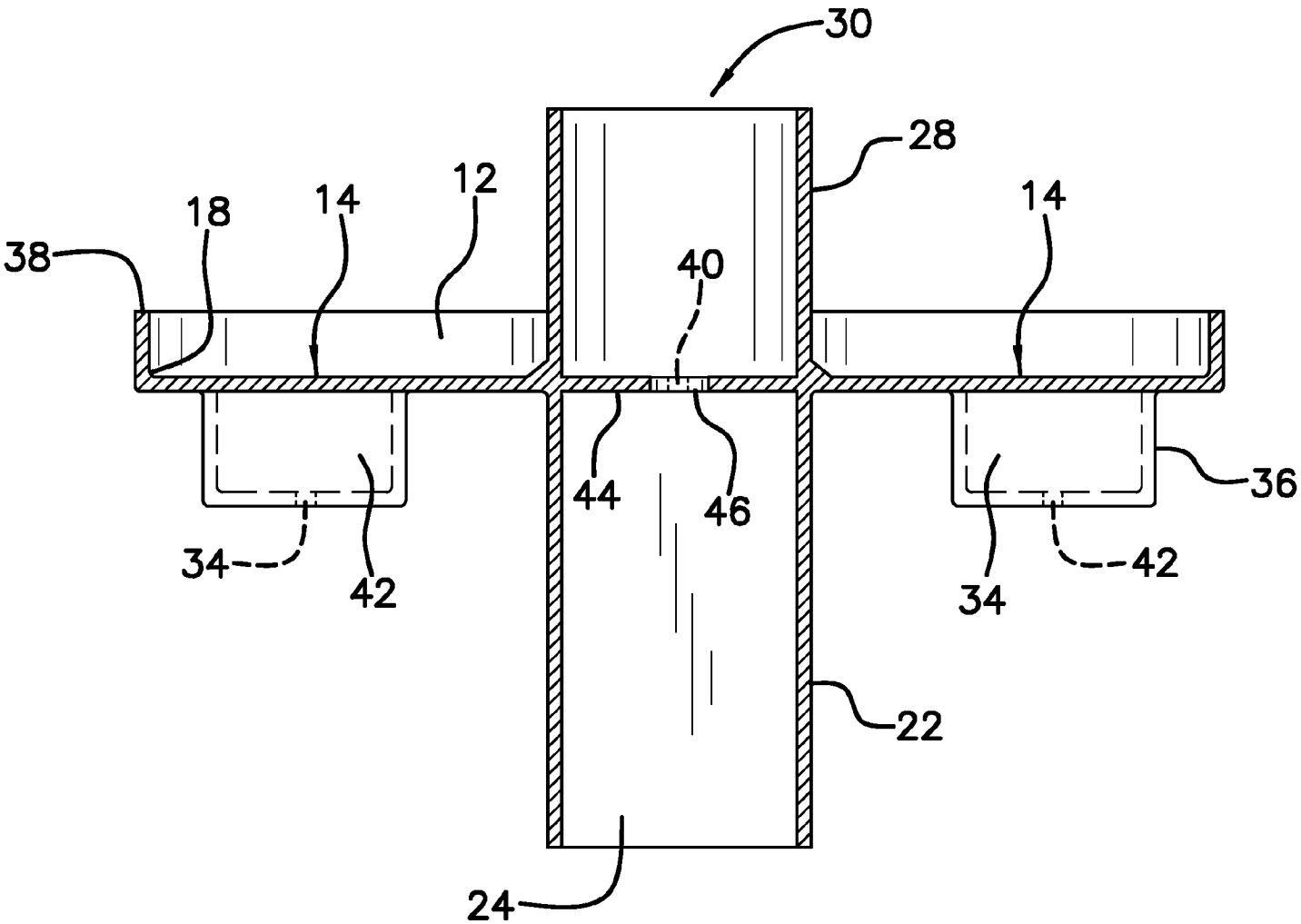
FIG. 4 is a cross-sectional view of an embodiment of the disclosure taken along line 4-4 of FIG. 2.
Figure 5:
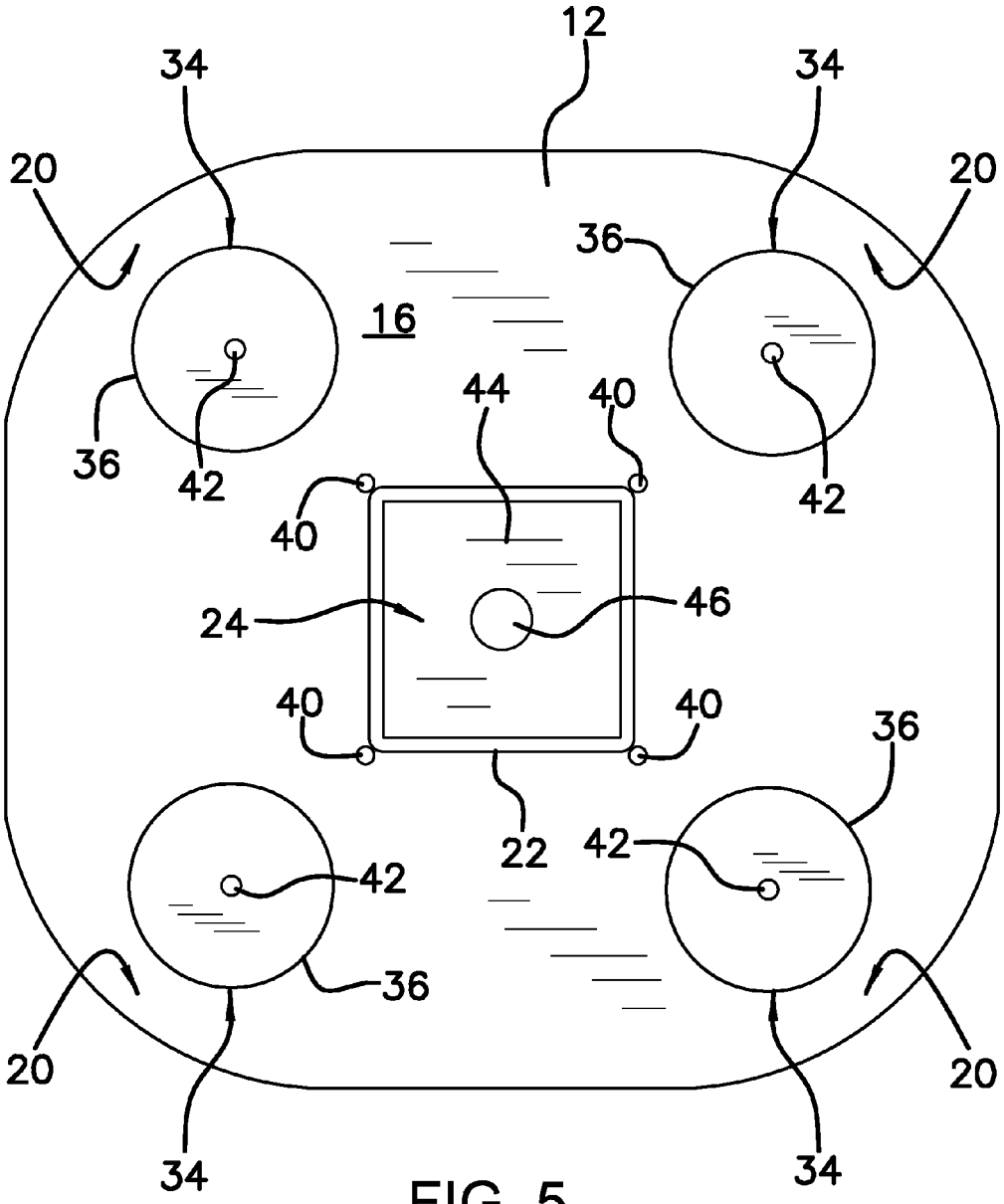
FIG. 5 is a bottom view of an embodiment of the disclosure.

With reference now to the drawings, and in particular to FIGS. 1 through 5 thereof, a new drink holder device embodying the principles and concepts of an embodiment of the disclosure and generally designated by the reference numeral 10 will be described.

As best illustrated in FIGS. 1 through 5, the post drink holder device 10 generally comprises a panel 12 having an upper surface 14, a lower surface 16, and a perimeter edge 18 extending around the upper surface 14 and the lower surface 16. The panel 12 is rectangular. The panel 12 has rounded corners 20. A base wall 22 is coupled to and extends downwardly from the lower surface 16 of the panel 12. The base wall 22 defines a post receiver 24 configured for receiving a post 26 of a dock therein such that the panel 12 is supported on the post 26. The base wall 22 is rectangular and centered on the lower surface 16 of the panel 12.

An upper wall 28 is coupled to and extends upwardly from the upper surface 14 of the panel 12 defining a primary cup 30 configured for receiving an associated beverage container 32 such as a bottle, glass, or the like. The upper wall 28 is circular and is centered on the upper surface 14 of the panel 12. Each of a plurality of outer cups 34 extends into the upper surface 14 and through the panel 12. Each outer cup 34 is configured for holding a respective associated beverage container 32. The outer cups 34 are radially arranged around the upper wall 28. Each outer cup 34 has a circular peripheral wall 36.

A lip 38 is coupled to and extends upwardly from the perimeter edge 18 of the panel 14 wherein the lip 38 surrounds the upper surface 14. Each of a plurality of drain apertures 40 extends through the panel 12. The drain apertures 40 are positioned proximate the upper wall 28. The upper surface 14 of the panel 12 is angled to taper downwardly from the lip 38 towards the upper wall 28 wherein fluid on the upper surface 14 is gravitationally urged towards the drain apertures 40.

The drain apertures 40 are radially arranged around the upper wall 28. Each of a plurality of cup drain openings 42 extends through a bottom wall 44 of an associated one of the outer cups 34. A central aperture 46 extends through the panel 12 between the primary cup 30 and the post receiver 24 preventing fluid accumulation in the primary cup 30.

In use, the panel 12 is positioned on the post 26. The primary cup 30 and each of the outer cups 34 may be used to hold beverage containers 32 such that the beverage containers 32 are not susceptible to being knocked off of the dock. The upper surface 14 of the panel 12 will not accumulate moisture and may be used to hold additional items if desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A post drink holder device comprising:

a panel having an upper surface, a lower surface, and a perimeter edge extending around said upper surface and said lower surface;

a base wall coupled to and extending downwardly from said lower surface of said panel, said base wall defining a post receiver configured for receiving a post therein such that said panel is supported on the post;

an upper wall, said upper wall being coupled to and extending upwardly from said upper surface of said panel defining a primary cup configured for receiving an associated beverage container;

a plurality of outer cups, each said outer cup extending into said upper surface and through said panel, each said outer cup being configured for holding a respective associated beverage container; and a central aperture, said central aperture extending fully through said panel, said central aperture being positioned between said primary cup and said post receiver, an edge of said panel defining said central aperture being inset relative to said upper wall and said base wall such that a portion of said panel is positioned between said primary cup and said post receiver.

2. The device of claim 1, further comprising said panel being rectangular.

3. The device of claim 2, further comprising said panel having rounded corners.

4. The device of claim 1, further comprising a lip coupled to and extending upwardly from said perimeter edge of said panel wherein said lip surrounds said upper surface.

5. The device of claim 1, further comprising said base wall being centered on said lower surface of said panel.

6. The device of claim 1, further comprising said upper wall being centered on said upper surface of said panel.

7. The device of claim 1, further comprising a plurality of drain apertures extending through said panel.

8. The device of claim 7, further comprising said drain apertures being positioned proximate said upper wall.

9. The device of claim 8, further comprising said drain apertures being radially arranged around said upper wall.

10. The device of claim 1, further comprising said outer cups being radially arranged around said upper wall.

11. The device of claim 1, further comprising said upper wall being circular.

12. The device of claim 1, further comprising each said outer cup having a circular peripheral wall.

13. The device of claim 1, further comprising said base wall being rectangular.

14. The device of claim 1, further comprising a plurality of cup drain openings, each said cup drain opening extending through a bottom wall of an associated one of said outer cups.

15. A post drink holder device comprising:

a panel having an upper surface, a lower surface, and a perimeter edge extending around said upper surface and said lower surface, said panel being rectangular, said panel having rounded corners;

a base wall coupled to and extending downwardly from said lower surface of said panel, said base wall defining a post receiver configured for receiving a post therein such that said panel is supported on the post, said base wall being rectangular, said base wall being centered on said lower surface of said panel;

an upper wall, said upper wall being coupled to and extending upwardly from said upper surface of said panel defining a primary cup configured for receiving an associated beverage container, said upper wall being circular, said upper wall being centered on said upper surface of said panel wherein said primary cup is vertically aligned with said post receiver;

a plurality of outer cups, each said outer cup extending into said upper surface and through said panel, each said outer cup being configured for holding a respective associated beverage container, said outer cups being radially arranged around said upper wall, each said outer cup having a circular peripheral wall;

a lip coupled to and extending upwardly from said perimeter edge of said panel wherein said lip surrounds said upper surface;

a plurality of drain apertures extending through said panel, said drain apertures being positioned proximate said upper wall, said drain apertures being radially arranged around said upper wall;

a plurality of cup drain openings, each said cup drain opening extending through a bottom wall of an associated one of said outer cups; and a central aperture, said central aperture extending fully through said panel, said central aperture being positioned between said primary cup and said post receiver, an edge of said panel defining said central aperture being inset relative to said upper wall and said base wall such that a portion of said panel is positioned between said primary cup and said post receiver.

* * * * *